US009791235B2

(12) United States Patent
McPherson

(10) Patent No.: US 9,791,235 B2
(45) **Date of Patent: *Oct. 17, 2017**

(54) STRING DAMPER HAVING APERTURE

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/011,271

(22) Filed: Jan. 29, 2016

(65) Prior Publication Data

US 2016/0146565 A1 May 26, 2016

Related U.S. Application Data

(63) Continuation of application No. 13/903,628, filed on May 28, 2013, now Pat. No. 9,250,031, which is a continuation of application No. 12/606,873, filed on Oct. 27, 2009, now Pat. No. 8,448,633.

(51) Int. Cl.

| | |
|---|---|
| ***A43C 11/22*** | (2006.01) |
| ***F41B 5/20*** | (2006.01) |
| ***A44B 17/00*** | (2006.01) |
| ***F41B 5/14*** | (2006.01) |

(52) U.S. Cl.

CPC ..... *F41B 5/1426* (2013.01); *F41B 5/1407* (2013.01); *A43C 11/22* (2013.01); *A44B 17/0023* (2013.01)

(58) Field of Classification Search

CPC .. F41B 5/1426; F41B 5/1407; A44B 17/0023; A43C 11/22

See application file for complete search history.

(56) References Cited

U.S. PATENT DOCUMENTS

| | | | | |
|---|---|---|---|---|
| D27,931 | S | 12/1897 | Eaton | |
| D33,108 | S | 8/1900 | Eaton | |
| D123,490 | S | 11/1940 | Saffell | |
| 2,326,693 | A * | 8/1943 | Sindler | A44B 15/00 24/17 B |
| 2,617,402 | A | 11/1952 | Roemer | |
| 2,777,437 | A | 1/1957 | Allen | |
| 2,910,058 | A | 10/1959 | Bender | |
| 2,956,560 | A | 10/1960 | Stockfleth | |
| 3,010,447 | A | 11/1961 | Roemer | |

(Continued)

FOREIGN PATENT DOCUMENTS

| | | |
|---|---|---|
| WO | 01/59392 | 8/2001 |
| WO | 0159393 | 8/2001 |

OTHER PUBLICATIONS

Dealer-Only Jennings Line Gets New Damping System, Unique Camo:, Arrowtrade, Jan. 2002 Edition, pp. 50-52.

(Continued)

*Primary Examiner* — John E Simms, Jr.

(57) ABSTRACT

A bow string vibration and noise damper includes an aperture and a body portion. The string vibration and noise damper is configured to be mounted on the bowstring. In this way, a closed loop is created by inserting at least a portion of the body portion through the aperture. The closed loop encircles a portion of the bowstring thereby attaching the string vibration and noise damper to the bowstring.

19 Claims, 5 Drawing Sheets

(56) References Cited

U.S. PATENT DOCUMENTS

| | | | | |
|---|---|---|---|---|
| 3,059,370 | A | 10/1962 | Moore | |
| 3,059,629 | A | 10/1962 | Stinson | |
| 3,331,720 | A | 7/1967 | Watson | |
| 3,340,862 | A | 9/1967 | Saunders | |
| 3,375,815 | A | 4/1968 | Novak | |
| 3,507,525 | A | 4/1970 | Sable | |
| 3,584,615 | A | 6/1971 | Stinson | |
| 3,588,963 | A * | 6/1971 | Moberg | G09F 3/14 24/16 PB |
| 3,597,803 | A * | 8/1971 | Van Neil | B65D 63/1027 24/16 PB |
| 3,612,029 | A | 10/1971 | Carroll | |
| 3,658,157 | A | 4/1972 | Lee | |
| D226,429 | S | 3/1973 | Christen | |
| 3,756,214 | A | 9/1973 | Christen | |
| 3,756,215 | A | 9/1973 | Black | |
| 3,757,761 | A | 9/1973 | Izuta | |
| 3,837,327 | A * | 9/1974 | Saunders | F41B 5/1407 124/92 |
| 3,937,205 | A | 2/1976 | Saunders | |
| 4,023,551 | A | 5/1977 | Huddleston | |
| 4,050,334 | A | 9/1977 | Davis, Jr. | |
| 4,061,125 | A | 12/1977 | Trotter | |
| 4,079,722 | A | 3/1978 | Griggs | |
| 4,080,951 | A | 3/1978 | Bateman, III | |
| D266,179 | S | 9/1982 | Peck | |
| RE31,541 | E | 3/1984 | Wood | |
| 4,461,267 | A | 7/1984 | Simonds et al. | |
| 4,628,892 | A | 12/1986 | Windedaul et al. | |
| 4,909,233 | A | 3/1990 | Stephenson | |
| 5,016,604 | A | 5/1991 | Tilby | |
| D322,022 | S | 12/1991 | Cunningham et al. | |
| 5,079,804 | A | 1/1992 | Gregurich et al. | |
| D343,234 | S | 1/1994 | Williams | |
| D344,123 | S | 2/1994 | Bertram | |
| 5,287,842 | A | 2/1994 | Saunders | |
| D346,423 | S | 4/1994 | Kitagawa | |
| 5,323,756 | A | 6/1994 | Rabska | |
| 5,368,006 | A | 11/1994 | McPherson | |
| 5,390,657 | A | 2/1995 | Larson | |
| 5,450,673 | A | 9/1995 | Denton | |
| 5,452,704 | A | 9/1995 | Winebarger | |
| 5,606,963 | A | 3/1997 | Wenzel et al. | |
| 5,680,851 | A | 10/1997 | Summers | |
| 5,715,578 | A * | 2/1998 | Knudson | B65D 63/10 24/115 L |
| 5,720,269 | A | 2/1998 | Saunders | |
| D410,272 | S | 5/1999 | Fitzgerald, Jr. | |
| RE36,555 | E | 2/2000 | Tentler | |
| 6,044,526 | A * | 4/2000 | Putney | A44B 99/00 24/17 AP |
| D426,612 | S | 6/2000 | Primeau, IV | |
| 6,237,584 | B1 * | 5/2001 | Sims | F41B 5/1407 124/92 |
| 6,257,220 | B1 | 7/2001 | McPherson et al. | |
| 6,412,586 | B1 | 7/2002 | Askew | |
| 6,443,139 | B1 | 9/2002 | McPherson | |
| 6,446,620 | B1 * | 9/2002 | Summers | F41B 5/1407 124/92 |
| 6,679,242 | B1 * | 1/2004 | Martin | F41B 5/1426 124/90 |
| 6,681,755 | B2 | 1/2004 | Pujos | |
| 6,761,158 | B2 | 7/2004 | Wright | |
| D503,769 | S | 4/2005 | Korn et al. | |
| 6,966,314 | B2 | 11/2005 | McPherson | |
| 7,082,937 | B1 | 8/2006 | Land | |
| D546,659 | S | 7/2007 | Smith | |
| 7,264,098 | B2 | 9/2007 | McPherson | |
| D584,134 | S | 1/2009 | Lee | |
| D600,773 | S | 9/2009 | Hall | |
| D627,460 | S | 11/2010 | Horton | |
| D628,669 | S | 12/2010 | McPherson | |
| D628,670 | S | 12/2010 | McPherson | |
| D629,896 | S | 12/2010 | Horton | |
| D650,036 | S | 12/2011 | McPherson | |
| 8,839,777 | B1 * | 9/2014 | Webb | F41B 5/1407 124/92 |
| 8,850,675 | B2 * | 10/2014 | Frydlewski | A43B 3/0078 24/300 |
| 2002/0162199 | A1 * | 11/2002 | Notomi | D04D 7/10 24/581.1 |
| 2003/0183219 | A1 * | 10/2003 | Wright | F41B 5/1407 124/92 |
| 2006/0011190 | A1 | 1/2006 | Andrews | |
| 2008/0040898 | A1 * | 2/2008 | Stolk | B60P 7/0823 24/298 |
| 2009/0107474 | A1 | 4/2009 | Silverson | |
| 2010/0089375 | A1 | 4/2010 | McPherson et al. | |
| 2010/0319670 | A1 | 12/2010 | Sims et al. | |

OTHER PUBLICATIONS

Bowhunting.net, eNews Bowhunting & Archery News & Articles, http://www.bowhunting.net/artman/publish/BowTech_WildThing.shtml, Copyright 2005, Retrieved Oct. 13, 2008.

Martin Archery 2003 catalog.

* cited by examiner

STRING DAMPER HAVING APERTURE

CROSS-REFERENCE TO RELATED APPLICATIONS

This application is a Continuation of U.S. patent application Ser. No. 13/903,628, filed May 28, 2013, which is a Continuation of U.S. patent application Ser. No. 12/606,873, filed Oct. 27, 2009, now U.S. Pat. No. 8,448,633, the entire content of which are hereby incorporated herein by reference.

BACKGROUND OF THE INVENTION

This invention relates to a damper for damping vibration and noise in an archery bow, and more specifically to a vibration damper attached to a bowstring for damping vibration and noise in the bowstring.

Various designs of string dampers are known to exist. Generally, these designs are of two types—those supported by the bowstring and those supported by some structure other than the bowstring. Of those not supported by the bowstring, some are attached to the bow riser or handle while others are attached to a bow limb. These types of string dampers generally brace a string or transfer energy to the supporting structure.

Known string dampers attached to a bowstring or cable directly can be attached by various methods; however, these present difficulty for servicing. For example, some dampers are secured to a bowstring by placing a part of the string damper between strands of the bowstring or placing a part of the string damper around the string in a way that requires disassembly of bow in order to remove or adjust the damper.

There remains a need for novel string dampers that can be easily attached to a bowstring or cable, easily moved along the bowstring or cable or removed entirely from the bowstring or cable, and yet remain fixedly secured to the bowstring or cable while attached, all without disassembly of the bow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a string damper comprises a body portion and an aperture portion being attached to the body portion. The string damper has a first relaxed configuration and a second bound configuration. In the second bound configuration, at least a portion of the body portion is disposed through the aperture portion.

In some embodiments, the body portion of the string damper further comprises a locking portion; the locking portion is configured to engage the aperture portion in the second bound configuration.

In some embodiments, the body portion of the string damper has a distal end. The locking portion is disposed between the aperture portion and the distal end.

In some embodiments, the locking portion comprises a tapered portion, the tapered portion tapering toward the distal end.

In some embodiments, the aperture portion defines an aperture axis. In some embodiments, the body portion defines a body portion axis. In a second configuration, the aperture axis is coaxial with the body portion axis.

In some embodiments, the body portion has an arcuate shape.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE INVENTION

A detailed description of the invention is hereafter described with specific reference being made to the drawings.

DETAILED DESCRIPTION OF THE INVENTION

Figure 1:
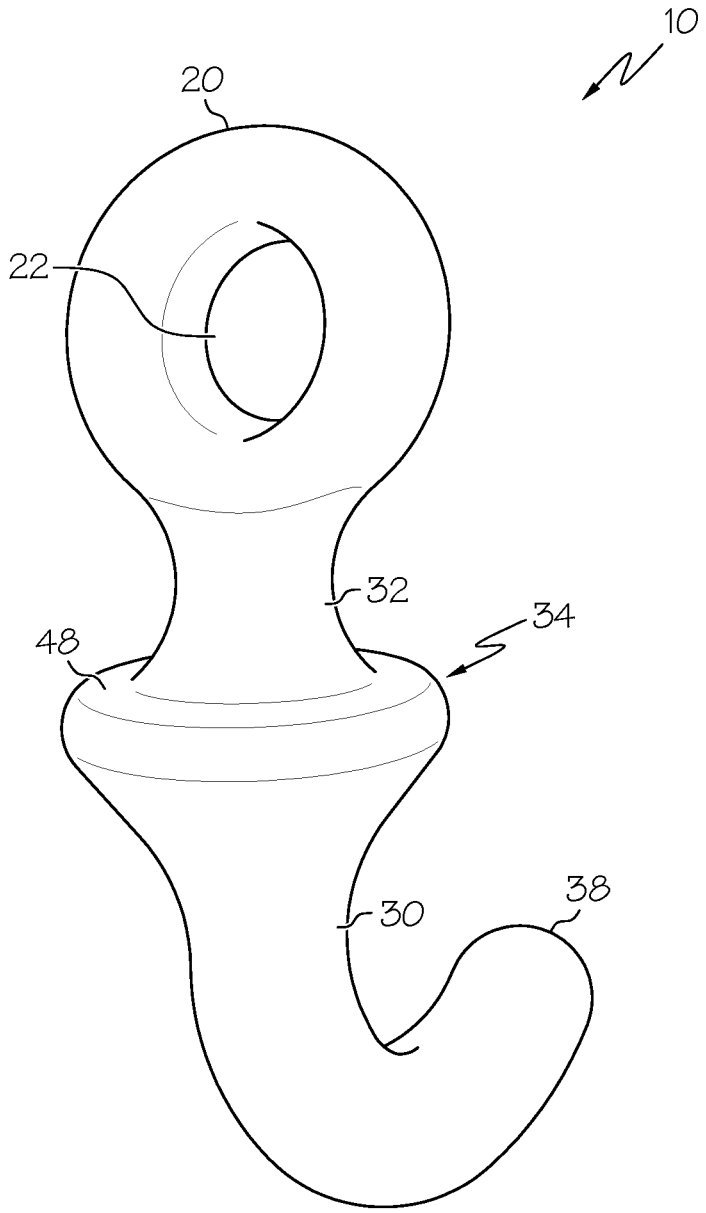
FIG. 1 shows an embodiment of the string vibration and noise damper.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a string damper 10 comprising an aperture portion 20 and a body portion 30. A portion of the body portion 30 is configured to be threaded through the aperture portion 20, forming a closed loop for securement to a bowstring of an archery bow.

In some embodiments, for example as shown in FIG. 1, an end of the body portion 30 is attached to the aperture portion 20. In some embodiments the body portion 30 is attached to the aperture portion 20 via an elongate portion 32. The elongate portion 32 shown in FIG. 1 extends proximally from the body portion 30 and attaches to the aperture portion 20 along a portion of the periphery of the aperture portion 20. In some embodiments, the elongate portion 32 is concave, being narrower at the middle than one or both of the ends. Furthermore, in some embodiments, the aperture portion 20 is substantially toroidally shaped, having a continuously convex surface. In this way, the concavity of the elongate portion 32 is similar to the convex curvature of the aperture portion 20. The aperture portion 20 can also comprise other suitable shapes.

In some embodiments, the body portion 30 comprises a distal end 38. The distal end 38 extends distally from the body portion 30. The distal end 38 can comprise any suitable shape, for example the body portion can taper along its length such that the distal end 38 is pointed. In some embodiments, the distal end 38 has a circular cross section; or, for example, the distal end 38 can have a rectangular cross section or any other suitable cross section.

Figure 2:
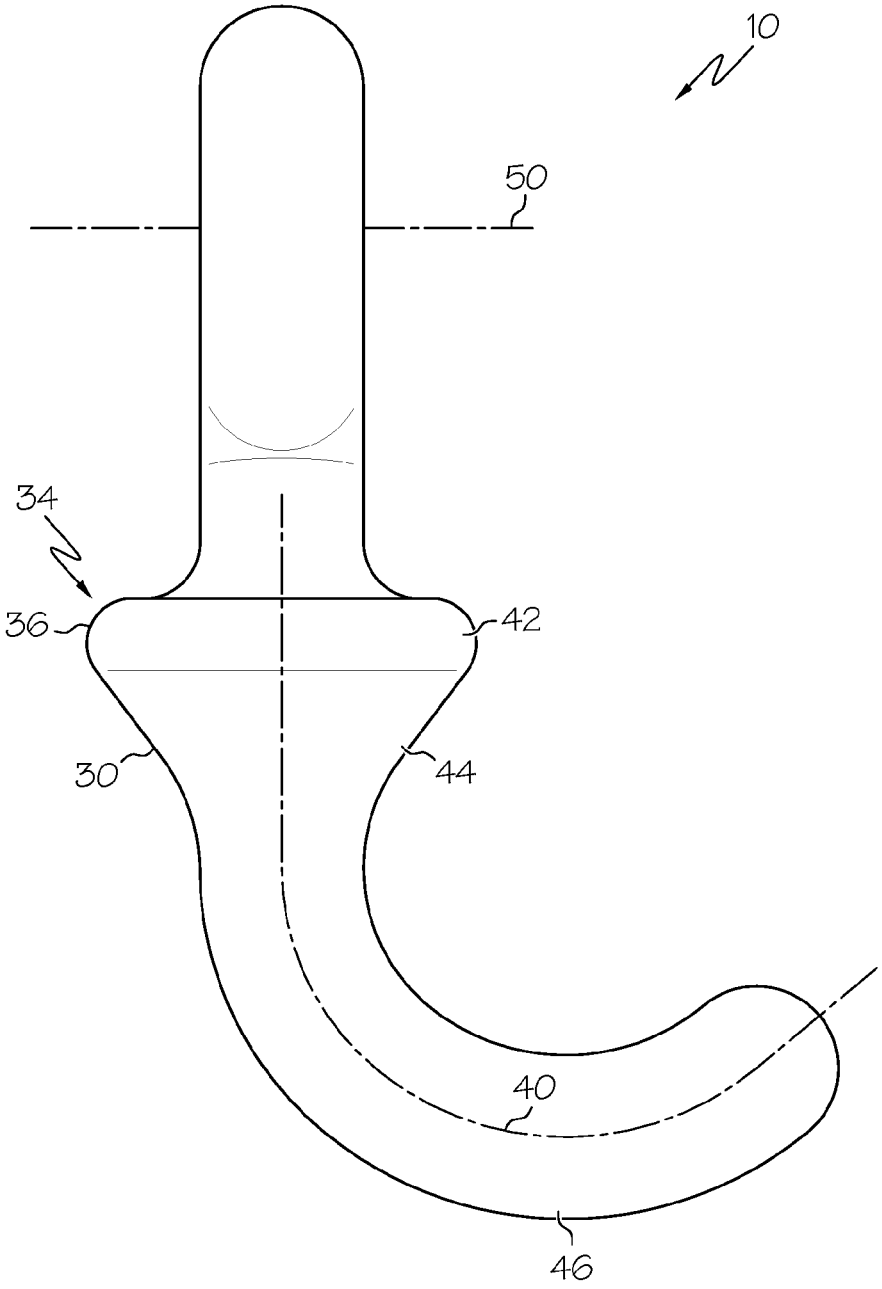
FIG. 2 shows a side view of an embodiment of the string vibration and noise damper.

Turning to FIG. 2, in some embodiments the string damper 10 defines a body portion axis or axis 40 extending longitudinally along at least a portion of the string damper 10. In some embodiments, the body portion axis 40 extends along the length of the body portion 30 from the aperture portion 20 to the distal end 38. In some embodiments, cross sections of the string damper 10 are generally symmetrical about the body portion axis 40, for example where the string damper 10 has circular or polygonal cross sections.

In some embodiments, the body portion axis 40 can comprise a central arcuate path, wherein the body portion axis 40 has a curved profile consistent with the curvature of the body portion 30. Where the body portion 30 is substantially straight along its length, the body portion axis 40 is similarly straight along its length. In some embodiments, the body portion axis 40 can be accurate, substantially straight, straight or any other suitable configuration consistent with the shape of the body portion 30.

In some embodiments, the aperture portion 20 generally defines an aperture 22 disposed therethrough (FIG. 1). As shown in FIG. 2, the aperture 22 has an aperture axis 50 disposed through the aperture 22. In some embodiments, the aperture axis 50 is generally coplanar with the cross sections of the aperture portion 20. For example, where the aperture portion 20 comprises a toroid, the aperture axis 50 is coplanar with the circular cross sections of the aperture portion 20. In some embodiments, aperture axis 50 is perpendicular to body portion axis 40 near the attachment location where the body portion 30 attaches to the aperture portion 20.

Figure 5:
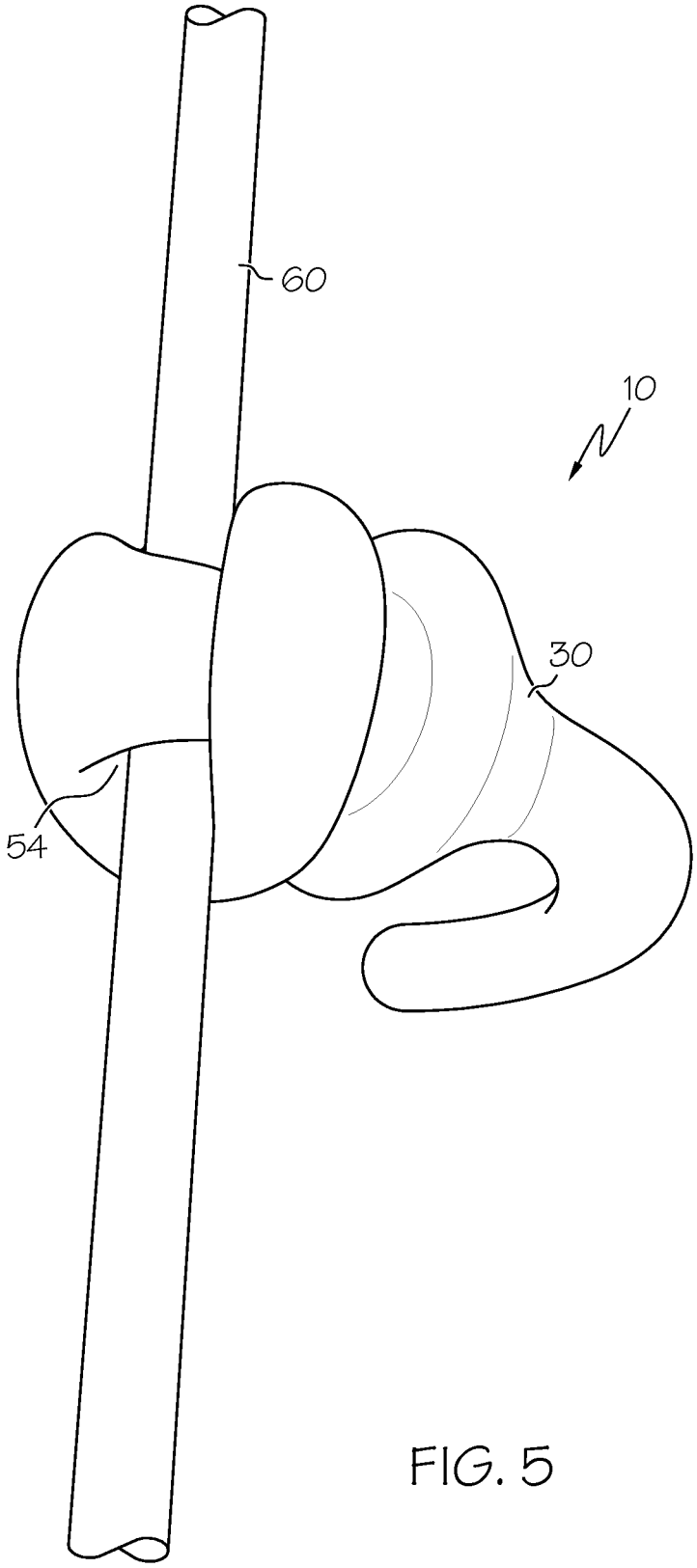
FIG. 5 shows an embodiment of the string vibration and noise damper secured to a bowstring.

The string damper 10 has a relaxed or first configuration (or first position) (FIG. 2) and a bound or second configuration (or second position) (FIG. 5). Alternatively, the first configuration may be referred to as a first state, and the second configuration may be referred to as a second state. In a first configuration, the string damper 10 is generally relaxed; whereas in a second configuration, the string damper 10 is generally contorted when compared to the first configuration and configured for mounting on a bowstring. In some embodiments, the elongate portion 32 is oriented in the aperture 22 when the string damper 10 is in a second configuration.

Figure 3:
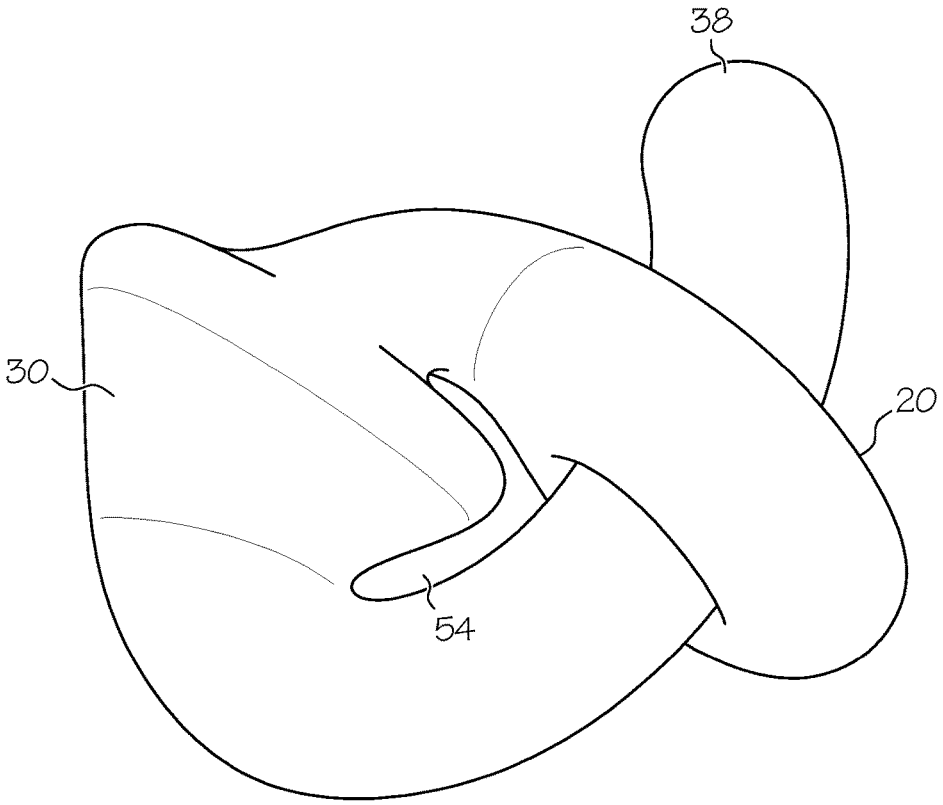
FIG. 3 shows an embodiment of the string vibration and noise damper in a partially bound configuration.

Turning now to FIG. 3, the string damper 10 is shown in a partially bound configuration, wherein a portion of the body portion 30 is partially threaded through the aperture 22 of the aperture portion 20. As shown in FIG. 3, the string damper 10 is in an intermediate configuration between the first relaxed configuration (e.g., FIG. 1) and the second bound configuration (e.g., FIG. 4). A closed loop 54 is formed by threading a portion of the body portion 30 through the aperture portion 20, beginning with the distal end 38.

Figure 4:
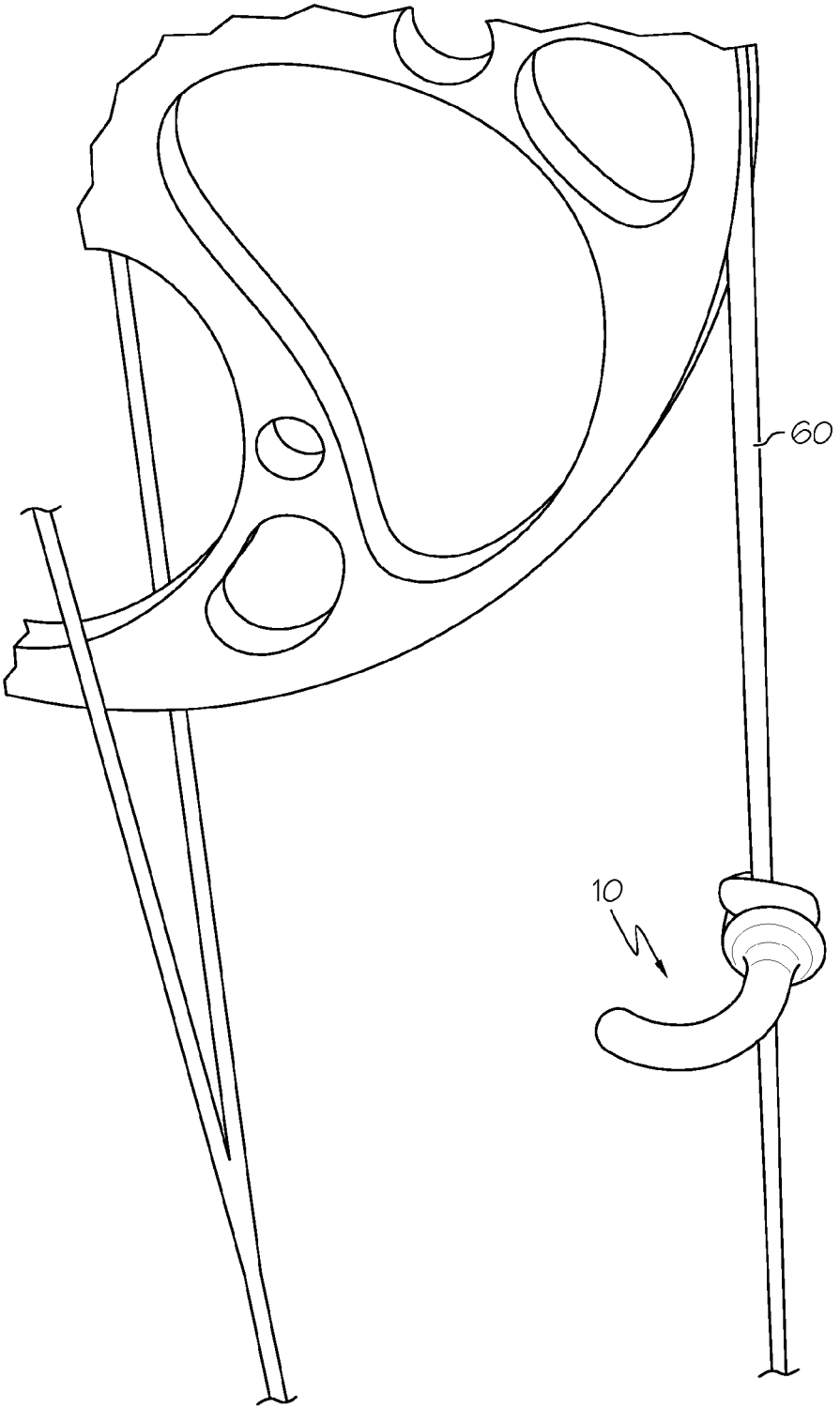
FIG. 4 shows an embodiment of the string vibration and noise damper secured to a bowstring.

FIG. 4 shows an embodiment of the string damper 10 attached to a bowstring 60. The bowstring damper 10 is attached to the bowstring by wrapping the distal end 38 of the body portion around the bowstring and threading the body portion 30 through the aperture 22 of the aperture portion 20. As shown in FIG. 4, the string damper 10 is attached to a draw cable. In some embodiments, the string damper 10 can be attached to any type of bowstring or bow cable, including, but not limited to, cross cables and power cables.

In FIG. 4, the string damper 10 is shown in a second or bound configuration, the body portion 30 being threaded through the aperture portion 20. The bowstring 60 passes through the closed loop 54 formed by threading a portion of the body portion 30 through the aperture 22 of the aperture portion 20.

FIG. 5 shows an embodiment of the string damper 10 attached to a bowstring 60. The body portion 30 is threaded through the aperture 22 of the aperture portion 20 thereby defining closed loop 54. The bowstring 60 is disposed through closed loop 54 and the string damper 10 is secured to the bowstring 60 by pulling on the distal end 38 of the body portion 30.

The string damper(s) 10 can be easily added to or removed from a string or cable of an archery bow, as described herein. As such, string dampers can be replaced or supplemented, as desired. Furthermore, the string damper(s) can be moved along the length of a string, or moved from one string to another without having to re-string the archery bow and without having to separate strands of the bowstring or remove string serving.

In some embodiments, the string damper 10 can comprise a unitary material, wherein the body portion is integral with the aperture portion.

A sting damper 10 can be made from any suitable material and is desirably sufficiently elastic that the damper 10 can reduce the vibrations present in a bowstring after firing an arrow. In some embodiments, the string damper 10 is formed from an elastomeric material such as natural rubber and/or various polymeric elastomers and/or combinations thereof. In some embodiments, the damper 10 is formed from one or more thermoplastic elastomer(s) such as Monprene® MP-1037-FL elastomer and/or Monprene® MP-2730 elastomer, available from Teknor Apex Company, 3070 Ohio Drive, Henderson, Ky. 42420.

In some embodiments, the cross sectional area of the aperture 22 is less than the cross sectional area of the body portion 30 when the string damper 10 is in a relaxed configuration. In this way, when the string damper 10 is placed in a bound configuration, the body portion 30 is positively engaged by the aperture portion 20, placing the aperture portion 20 in tension around the elongate portion 32 and preventing the string damper 10 from inadvertently coming loose, falling off or moving along the bowstring. In some embodiments, the cross sectional area of the aperture 22 is less than the cross sectional area of the elongate portion 32 or a portion of the elongate portion 32. As such, when the string damper 10 is in a bound configuration, the aperture portion 20 tightly engages the body portion 30 disposed in the aperture 22.

In some embodiments, the aperture 22 of the aperture portion 20 is circular. However, other suitable configurations are also acceptable. Moreover, the shape of the aperture portion 20 defining aperture 22 can coincide with a particular shape of the cross section of the body portion 30 or a portion of the body portion, specifically elongate portion 32. For example, if the cross section of the body portion 30 (or a portion of the body portion) is circular, the aperture 22 can comprise a circular opening. Other suitable cross sections can also be used.

In some embodiments, the aperture portion 20 is generally toroidally (or doughnut) shaped. In this case, the aperture portion 20 has a circular cross section of material. The aperture portion 20 can also comprise other suitable cross sections. For example, the aperture portion can have an elliptical, oblong, or polygonal cross section, or any other suitable cross section.

In some embodiments, for example as shown in FIG. 2, the string damper 10 comprises a locking portion or locking mechanism 34. The locking mechanism 34 is configured to retain the string damper 10 on a bowstring or cable. In some embodiments, the locking mechanism 34 prevents the string damper 10 from loosening on the bowstring by engaging the aperture portion 20.

In at least one embodiment, the locking mechanism 34 comprises a raised flange 36, for example as shown in FIG. 2. The raised flange 36 is configured to retain the aperture portion 20 when the string damper 10 is in a second configuration and hold the string damper 10 on a bowstring (FIG. 5).

Turning again to FIG. 2, in some embodiments the body portion axis 40 extends through at least a portion of the elongate portion 32. The portion of the body portion axis 40 extending through the elongate portion 32 is alternatively referred to as the elongate segment of the body portion axis 40. The elongate segment generally extends the length of the elongate portion 32, from the aperture portion 20 to the locking mechanism 34. In some embodiments, the elongate segment of the body portion axis 40 is perpendicular to the aperture axis 50 when the string damper 10 is in a first configuration, for example as shown in FIG. 2.

In some embodiments, the elongate segment of the body portion axis 40 is coaxial with the aperture axis 50 when the string damper 10 is in a second or bound configuration, for example as shown in FIG. 5.

In some embodiments, the cross sectional area of the locking mechanism 34 is generally greater than the cross sectional area of the portion of the body portion 30 oriented in the aperture 22. In some embodiments, the cross sectional area of the locking mechanism 34 is greater than the cross sectional area of the elongate portion 32. Furthermore, the cross section of the locking mechanism 34 is greater than the cross section of the aperture 22.

In some embodiments, the locking mechanism 34 has a peak 42 and a tapered or sloping portion 44. As shown in FIG. 2, the peak 42 has a greater cross sectional area than other portions of the body portion 30. Notably, the peak 42 has a larger cross section than the aperture 22.

The sloping portion 44 is generally distal to the peak 42. The tapered or sloping portion 44 transitions into arm portion 46 and eases pulling locking mechanism 34 through aperture 22 during placement of the string damper 10 on the cable or bowstring. In some embodiments, the sloping portion 44 is frustoconical.

In some embodiments, the arm portion 46 is a portion of the body portion 30. In some embodiments, the arm portion 46 is curved. The arm portion 46 can also comprise other suitable shapes. The arm portion 46 may alternatively be referred to as damping portion 46.

In some embodiments, the side of the locking mechanism 34 opposite the sloping portion 44 comprises a first surface 48 (FIG. 1). In some embodiments the first surface 48 has an angle of incline greater of the sloping portion 44. In some embodiments, the first surface 48 of the locking mechanism 34 is substantially orthogonal to the body portion axis 40 where the body portion axis 40 passes through the first surface 48. In some embodiments, the first surface 48 has a negative angle of incline, wherein the first surface 48 slopes in the same general direction as the sloping portion 44. The first surface 48 can also be concave or convex.

In some embodiments, when the string damper 10 is attached to a bowstring, for example as shown in FIGS. 4 and 5, the string damper is asymmetrical about the bowstring 60, having only a single arm portion 46. In at least one embodiment, the string damper 10 has neither rotational symmetry about the bowstring 60 nor any mirroring symmetry across the bowstring 60. However, as discussed earlier, the string damper 10 can be symmetrical about its own axis 40 (FIG. 2).

Generally, the string damper 10 is secured to a bowstring by wrapping a portion of the body portion 30 around the bowstring, threading the distal end 38 of the string damper 10 through the aperture 22 of the aperture portion 20, pulling on the distal end 38, and securing the string damper 10 on the string.

In some embodiments, the body portion 30 is configured such that a locking mechanism 34 is pulled through the aperture 22 until the aperture portion 20 abuts the first surface 48, thereby securing the string damper 10 on the string. Furthermore, the string damper 10 can be rotated relative to the bowstring to position the arm 46 in a desired orientation, for example substantially perpendicular to the direction of bowstring travel. The string damper can be oriented in any suitable configuration to maximize damping effectiveness.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bowstring damper comprising:

a single piece body comprising a damping portion, a locking flange and an aperture portion, the aperture portion defining an aperture, the damping portion comprising an arm that extends asymmetrically from the locking flange;

the body having a first configuration wherein the locking flange is located between the aperture portion and the damping portion;

the body attachable to a bowstring.

2. An archery bowstring damper comprising:

a single piece body comprising a damping portion, a locking flange and an aperture portion, the aperture portion defining an aperture;

the body having a first configuration wherein the locking flange is located between the aperture portion and the damping portion;

the body attachable to a bowstring;

wherein the single piece body comprises an elastomeric material.

3. The archery bowstring damper of claim 2, wherein the single piece body consists of said elastomeric material.

4. The archery bowstring damper of claim 1, the aperture portion comprising a ring.

5. The archery bowstring damper of claim 1, the aperture portion comprising a toroid.

6. The archery bowstring damper of claim 1, wherein the aperture is circular.

7. The archery bowstring damper of claim 1, wherein a length of damping portion is greater than a distance between the aperture portion and the locking flange.

8. The archery bowstring damper of claim 1, in the first configuration, a central axis of the aperture is non-parallel to a central axis of the locking flange.

9. The archery bowstring damper of claim 8, wherein the central axis of the aperture is orthogonal to the central axis of the locking flange.

10. The archery bowstring damper of claim 1, wherein a distance across the locking flange is greater than a distance across the aperture.

11. The archery bowstring damper of claim 1, the locking flange comprising a taper.

12. The archery bowstring damper of claim 1, the body having a second configuration wherein the body forms a loop and the locking flange abuts the aperture portion.

13. The archery bowstring damper of claim 1, the body having a second configuration wherein a portion of the body is oriented in the aperture.

14. The archery bowstring damper of claim 1, the locking flange forming a ridge.

15. An archery bowstring damper comprising:

a single piece body comprising a damping portion, a locking flange and an aperture portion, the aperture portion defining an aperture;

the body having a first configuration wherein the locking flange is located between the aperture portion and the damping portion;

the body attachable to a bowstring;

wherein said damping portion is arcuate.

16. The archery bowstring damper of claim 1, wherein a cross-sectional shape of said locking flange is circular.

17. The archery bowstring damper of claim 2, wherein a cross-sectional shape of said locking flange is circular.

18. The archery bowstring damper of claim 2, the body having a second configuration wherein the body forms a loop and the locking flange abuts the aperture portion.

19. The archery bowstring damper of claim 15, the body having a second configuration wherein the body forms a loop and the locking flange abuts the aperture portion.

* * * * *